US010358762B2

(12) United States Patent
LV et al.

(10) Patent No.: US 10,358,762 B2
(45) Date of Patent: Jul. 23, 2019

(54) DRAINAGE DEVICE OF WASHING MACHINE, AND WASHING MACHINE

(71) Applicant: QINGDAO HAIER WASHING MACHINE CO., LTD., Laoshan, Qingdao (CN)

(72) Inventors: Peishi LV, Qingdao (CN); Lin Yang, Qingdao (CN); Zunan Liu, Qingdao (CN); Lingchen Wang, Qingdao (CN); Yunlong Tian, Qingdao (CN); Yanni Jiang, Qingdao (CN); Weihai Li, Qingdao (CN)

(73) Assignee: QINGDAO HAIER WASHING MACHINE CO., LTD., Shandong, Qingdao (CN)

( * ) Notice: Subject to any disclaimer, the term of this patent is extended or adjusted under 35 U.S.C. 154(b) by 221 days.

(21) Appl. No.: 15/316,970

(22) PCT Filed: Nov. 18, 2014

(86) PCT No.: PCT/CN2014/091406
§ 371 (c)(1),
(2) Date: Dec. 7, 2016

(87) PCT Pub. No.: WO2015/188587
PCT Pub. Date: Dec. 17, 2015

(65) Prior Publication Data

US 2017/0114493 A1 Apr. 27, 2017

(30) Foreign Application Priority Data

Jun. 11, 2014 (CN) ..... 2014 1 0258714

(51) Int. Cl.
*D06F 39/08* (2006.01)
*D06F 35/00* (2006.01)
*D06F 39/10* (2006.01)

(52) U.S. Cl.
CPC ..... *D06F 39/086* (2013.01); *D06F 35/008* (2013.01); *D06F 39/085* (2013.01); *D06F 39/10* (2013.01)

(58) Field of Classification Search
CPC ..... D06F 39/10; D06F 39/085; D06F 39/086; D06F 35/008
See application file for complete search history.

(56) References Cited

U.S. PATENT DOCUMENTS 3,228,525 A * 1/1966 Evans ..... D06F 39/10 210/167.01
3,466,901 A * 9/1969 Reid ..... D06F 37/145 210/136

(Continued)

FOREIGN PATENT DOCUMENTS

CN 201358374 Y 12/2009
CN 102234902 A 11/2011

(Continued)

OTHER PUBLICATIONS

Machine English Translation of Description of CN 102733157 (Lv et al. Oct. 2012) (Year: 2012).*

(Continued)

*Primary Examiner* — Joseph L. Perrin
*Assistant Examiner* — Irina Graf
(74) *Attorney, Agent, or Firm* — Buchanan Ingersoll & Rooney PC

(57) ABSTRACT

A washing machine has cleaning particles provided between an outer barrel and an inner barrel. A water outlet on the outer barrel communicates with a drainage device including a drain valve body having a particle receiving and discharging chamber and a drainage chamber. The particle collecting and discharging chamber has a water inlet. The drainage chamber has a water outlet. A particle filtering structure is provided between the particle receiving and discharging (Continued)

chamber and the drainage chamber. One side of the particle collecting and discharging chamber has an opening with a sealing cover including an outer cover and an insertion portion inserted through the opening, and fitting the edge wall of the particle receiving and discharging chamber. An inner wall of the insertion portion has a plurality of protrusions for supporting the cleaning particles. Gaps between the protrusions are smaller than a minimum diameter of the cleaning particles.

12 Claims, 3 Drawing Sheets

(56) References Cited

U.S. PATENT DOCUMENTS

| | | | | |
|---|---|---|---|---|
| 5,660,063 | A * | 8/1997 | Lee | D06F 39/10 210/167.01 |
| 7,406,843 | B2 * | 8/2008 | Thies | D06F 39/10 134/110 |
| 2004/0129034 | A1 * | 7/2004 | Zanello | D06F 39/10 68/18 F |
| 2005/0246843 | A1 * | 11/2005 | Song | D06F 39/10 8/158 |
| 2012/0024773 | A1 * | 2/2012 | Morrison | A47L 15/4204 210/409 |
| 2013/0127263 | A1 | 5/2013 | Park | |
| 2013/0276484 | A1 * | 10/2013 | Mantle | D06F 39/10 68/18 F |
| 2014/0047869 | A1 * | 2/2014 | Kim | D06F 58/22 68/19.2 |

FOREIGN PATENT DOCUMENTS

| | | | | |
|---|---|---|---|---|
| CN | 102733156 | A * | 10/2012 | D06F 39/10 |
| CN | 102733157 | A | 10/2012 | |

OTHER PUBLICATIONS

Machine English Translation of Description of CN 102733156 (Lv et al. Oct. 2012) (Year: 2012).*

International Search Report (PCT/ISA/210) dated Feb. 17, 2015, by the State Intellectual Property Office of the P.R. China as the International Searching Authority for International Application No. PCT/CN2014/091406.

Written Opinion (PCT/ISA/237) dated Feb. 17, 2015, by the State Intellectual Property Office of the P.R. China Patent Office as the International Searching Authority for International Application No. PCT/CN2014/091406.

* cited by examiner

DRAINAGE DEVICE OF WASHING MACHINE, AND WASHING MACHINE

FIELD OF THE INVENTION

The present disclosure relates to the field of washing machine, and more particularly, to a drainage device of a washing machine and a washing machine.

BACKGROUND OF THE INVENTION

The space between inner barrel and outer barrel is a closed environment which only water can pass in existing washing machines. Due to the structure limitations of the washing machine and the particularity of using environment, the outer wall of the inner barrel and the inner wall of the outer barrel will adhere to dirt which will breed bacteria in varying degrees after using 3-5 months and most of the bacteria bred are harmful to human body.

With the improvement of people's living standards and the improvement of the quality of life, it is urgent to solve the hygienic problem of the washing machine. Relevant research institutions on the internal environment of the washing machine survey shows that the seriousness of the internal pollution of the washing machine has drawn more and more consumers' attention. In order to fundamentally avoid the secondary pollution of the washing machine on the clothes, it is urgent to overcome the problem of cleaning the internal environment of the washing machine and better to be responsible for the health of users.

Patent No. CN200820183308.4 discloses a bucket washing machine with bucket cleaning which comprises an inner barrel, an outer barrel and several round silicone balls for cleaning walls of inner and outer barrels. The use of flow of water which driven by the rotation of the inner barrel, thereby driving the silicone balls between the inner and outer barrels and walls of inner and outer barrels continue to impact with each other to achieve the purpose of cleaning the inside and outside the barrel wall.

Besides, patent No. CN201010160548.4 which applied by the applicant discloses a washing machine using flexible particles for cleaning space between inner and outer barrels and a method therefore. The washing machine is characterized in that flexible particles are arranged between the inner and outer barrels of the washing machine, and are driven by the regular flow of water to impact and rub the walls of the inner and outer tubs of the washing machine in the clothes washing process so as to clean the space between the inner and outer tubs of the washing machine.

However, after the drainage the washing machine structure, as the rubber ball or flexible particles in the barrel is in the free-fall state so that the high-speed spin process will produce a lot of noise and the energy consumption of washing machines increasing and affect the washing machine's life cycle. Therefore, there is a need for improvements in the structure of the existing drainage device. A drainage device with a filter structure for collecting cleaning particles and discharging the clogs without being clogged and for automatically delivering cleaning granules at next washing which can be freely disassembled for replace cleaning particles.

Moreover, patent No. CN201210189764.0 which applicant applied discloses a drainage device of a washing machine. The washing machine comprises an outer barrel, an inner barrel and an impeller, wherein cleaning particles for cleaning the walls of the barrels are arranged between the inner barrel and the outer barrel; an outlet is arranged at the bottom part of the outer barrel as shown in FIG. 1; the drainage device comprises a particle collecting and discharging chamber 1' for containing the cleaning particles when dewatering and enabling the cleaning particles to float into the outer barrel to clean the wall of the barrel by buoyancy force when feeding water, and a drainage chamber 2'; the particle collecting and discharging chamber 1' is communicated with the outlet through an interconnection pipe 3'; the particle collecting and discharging chamber 1' has an inclined inner wall structure capable of enabling the cleaning particles 4' to float along with raised water level so as to enter into the interconnection pipe along the inner wall and enter into the outer barrel via the outlet;

However, after a large number of experiments, the structure still has the following problems: 1. The cleaning particles adhering to the inclined inner wall and can't float to the outer barrel through the inlet when water flowing in the washing machine. The cleaning particles will be crowed in the lower part of inclined wall due to the upper can't float for a long time. 2, If the particles stored in the particle retracting chamber for a long time, then the bottom of the cleaning particles by squeezing completely adhere to the bottom wall of the particle collection chamber is not conducive to its full delivery; 3. Part of the lint will be remained in the filter structure, a longer time accumulation will affect the drainage efficiency.

In view of the foregoing, the present invention is proposed.

SUMMARY OF THE INVENTION

The technical problem to be solved by the present disclosure is to overcome the shortcomings of the prior art and provide a drainage device of washing machine with cleaning particles between inner and outer barrels for the function of cleaning barrel wall. The device utilizes the improved structure to reduce the contact between the cleaning particles and the inner wall of the particle collecting and discharging chamber so as to avoid clogging caused by the cleaning particles remaining in the particle collecting and discharging chamber so as to make the floating particles float more quickly and stably every time.

The other object of the present disclosure is to provide a washing machine equipping with the drainage device mentioned above.

To solve the technical problem mentioned above, the basic idea of adopting the technical scheme of the disclosure is: a drainage device of a washing machine comprising, a drain valve body. The drain valve body is divided into a particle collecting and discharging chamber and a drainage chamber communicating with each other, an upper wall of the particle collecting and discharging chamber is provided with a water inlet and the drainage chamber is provided with a water outlet. A particle filtering structure is provided between the particle collecting and discharging chamber and the drainage chamber. One lateral side of the particle collecting and discharging chamber is provided with an opening, and the opening has a sealing cover installed thereon. The sealing cover comprises an outer cover and an insertion portion; the insertion portion is inserted through the opening, and fits the edge wall of the particle collecting and discharging chamber. The inner wall of the insertion portion is provided with a plurality of protrusions for supporting the cleaning particles; and gaps between the protrusions are smaller than the minimum diameter of the cleaning particles.

Further, the insertion portion comprises an extension which is fitted to the upper surface of the particle collecting and discharging chamber and extends toward the water inlet, protrusions are provided on a lower surface of the extension, and the heights of the protrusions are gradually lowered toward the water inlet from the side of the outer cover. Preferably, the extension extends below the side wall of the water inlet, and the extension and the protrusion smoothly transitions to the side wall of the water inlet side. The contact surface of the cleaning particles and the upper wall of the particle collecting and discharging chamber is reduced by the protrusion structure so that to reduce the friction sliding to the water inlet when the cleaning particles floating. The gap between the protrusions is conducive to the movement of water flow, which will help particles floating into an outer barrel of the washing machine through the water inlet.

Further, the lower end surfaces of the protrusions of the lower surface of the extension together form a smooth inclined surface gradually increasing from the outer cover toward the water inlet. The structure allows the cleaning particles to float smoothly with water to the outer barrel through the water inlet.

Further, the protrusions are long ribs extending from the outer cover toward the water inlet, a strip-shaped water channel is formed between adjacent long ribs, and the height of the downward long ribs is lowered along the direction from the outer cover side to the water inlet.

Further, the long ribs and the strip-shaped water channels are arranged in turn at intervals, the long ribs are in an upright sheet-like structure, and the lower side portion has an arc-shaped structure extending from the outer cover toward the water inlet, the width of the strip-shaped water channel is less than the minimum diameter of the cleaning particles. The arc-shaped structure of the lower edge of the long rib is downward convex shape, that is, the center of the arc-shaped structure is located above the long rib. The arc-shaped structure makes the contact area between the cleaning particles and the long rib with the smallest when the cleaning particles floating up, conducive to the cleaning particles floating to the water inlet.

Further, between the particle collecting and discharging chamber and the drainage chamber is provided with a water retaining rib protruding from the inner wall of the particle collecting and discharging chamber so as to retain final residual water in the particle collecting and discharging chamber not to be discharged. The cleaning particles are collected in the particle collecting and discharging chamber with each drainage, and the residual water is blocked by the water retaining ribs so that cleaning particles in the bottom do not contact with the bottom wall of the particle collecting and discharging chamber to avoid sticking to the bottom wall for a long time, which will cause blockage.

Further, the water retaining rib is a raised rib formed by compressing the drain valve body from outside to inside at the position between the particle collecting and discharging chamber and drainage chamber.

Further, an arc chamfering is provided between the water retaining rib and the inner wall of particle collecting and discharging chamber, the side of the water retaining rib corresponding to the side of the particle collecting and discharging chamber is curved, and smooth transition is made with the arc chamfering. The water retaining rib structure is not easy to hang lint, so as to solve the blockage problem on the drainage caused by the lint, especially the relatively long lines of lint, easy to hang on the water retaining ribs.

Further, a particle filtering structure is a comb-shaped grid structure composed of a plurality of blocking rib, and one side of the blocking rib corresponding to the particle collecting and discharging chamber is protruded from the side portion of the water retaining rib corresponding to the particle collecting and discharging chamber. The arrangement prevents the lint from being blocked by the water retaining rib, and the lint is to be hung on the blocking rib first, and is slide out along with water flows.

The particle filter structure comprises two groups of opposing gratings, and between the two groups of gratings are a narrow and long passage, each group of grating is formed as comb-shaped structure by a plurality of blocking ribs extending from one side of inner wall to the passage. The side of the blocking ribs corresponding to the particle collecting and discharging chamber is inclined to the passage from the edge along the water discharge direction, and constitute an arc-shaped inclined end surface form the passage position concave to the drainage chamber. The gap between two adjacent blocking ribs of each group of gratings is smoothly communicated with the passage at the end of the blocking ribs. When draining, the line-like lint hanging on the blocking ribs slides along the curved sloping end towards the end of the blocking ribs and slides out from the passage to the drainage chamber.

Further, the water inlet is arranged above the side of the particle collecting and discharging chamber which is close to the particle filtering structure, and the side of the blocking ribs corresponding to the particle collecting and discharging chamber protrudes to the projection area where the water inlet is located in the particle collecting and discharging chamber. The structure facilitates floating of the cleaning particles in front of the particle filtering structure. In contrast to the prior art, the inclination structure of the upper side of the particle collecting and discharging chamber corresponding to the particle filtering structure is reduced, and the depth of the particle collecting and discharging chamber side corresponding to the opening is relatively increased.

Further, the water outlet is arranged below the drainage chamber, an overflow outlet is provided on a side wall of the drainage chamber, and the overflow outlet is connected with an overflow port of an outer barrel through an overflow pipeline.

A washing machine comprises an outer barrel and an inner barrel of the present disclosure, cleaning particles for cleaning barrel walls are provided between the inner and outer barrels, a water outlet at a bottom of the outer barrel is communicated with the drainage device below.

In the washing process of the present disclosure, cleaning particles are driven by water flow to impact and rub the inner and outer barrel wall of the washing machine to realize the cleaning of the barrel wall between the inner and outer barrels of the washing machine; after the washing process ends, the washing water is discharged from the drainage device, and cleaning particles are collected in the particle collecting and discharging chamber; the cleaning particles can float in the water, and impact the inner and outer barrel wall between the inner and outer barrels with the water flow.

Placing cleaning particles between the inner and outer barrels to clean the inner and outer barrel wall of the washing machine is a reference to the principle of laundry rubbing against the inner barrel so that it is not adhered to dirt and breed bacteria; the cleaning particles can be sponge-like substances or rubber and plastic foams substances such as foam rubber, foam plastic, foam composite polyurethane which have the characteristic as following: it has a certain flexibility, its density is smaller than the one of water in dry state, has a certain flexibility and wear resistance, in the water with a water-soaked nature, cheap. The cleaning particles can be taken out and recycled by directly opening the sealing cover of the particle collecting and discharging chamber after a plurality of times of use, then new cleaning particles are used.

The cleaning particles are spherical, square, oval spherical, cylindrical, tetrahedral or other irregular granular material, the number of 3-50.

By adopting the technical proposal, the disclosure has the following beneficial effects compared with the prior art.

The drainage device can collect the cleaning particles with discharging water to avoid the noise generated when the cleaning particles hit the barrel wall between the inner and outer barrels during the dehydration stage, especially for the washing machine with the function of cleaning the barrel walls by placing cleaning particles between the inner and outer barrels. And in the next washing, the buoyancy of the water completely re-delivery the cleaning particles to clean the barrel walls between the inner and outer barrels. The improved structure makes it easier to re-use the cleaning particles, avoiding the clogging caused by the adhesion of the cleaning particles on the inner wall. The structure is simple and the production and installation cost is low.

The present disclosure achieves that a small portion of water is retained in the particle collecting and discharging chamber by providing a water retaining rib between the particle collecting and discharging chamber and the drainage chamber, avoiding the cleaning particles in the bottom adhered to the inner wall, conducive to its next float to redeliver. Further, the improved water retaining ribs are respectively matched with the inner wall of the particle collecting and discharging chamber and the filtering structure to realize the smooth discharge of the lint, which is conducive to the passage of the lint and no clogging. The invention has the advantages of simple structure and reasonable design, and overcomes the difficult problem that the blow molding process is raised in the particle collecting and discharging chamber. By providing a protrusion on the insertion portion of the sealing cover which matches the opening to reduce the contact surface of the cleaning particles, better results are achieved by helping the cleaning particles floating. The use of the gap between the protrusions, makes the flow of water to promote the movement of cleaning particles to facilitate the delivery of cleaning particles. When the cleaning particles are put in the present disclosure, the cleaning particles in the particle collecting and discharging chamber are quickly and effectively raised up to the space between the inner and outer barrels to avoid bacterial clogging caused by drainage clogging and remnants.

DETAILED DESCRIPTION OF THE INVENTION

Specific embodiments of the present disclosure are further described below in detail with reference to the accompanying drawings.

A drainage device of the present disclosure is installed below an outer barrel of a washing machine, and is connected with a drainage outlet of the washing machine. The washing machine comprises the outer barrel and an inner barrel. Cleaning particles for cleaning the barrel walls are placed between the inner and outer barrels, which float in water. The cleaning particles compact and rub the barrel walls which driven by water flow to clean the inner and outer barrel walls during the washing process. After the washing process, the washing water is discharged through a drainage device and the cleaning particles are collected inside the drainage device. And the cleaning particles float between the outer barrel and the inner barrel with water flow when the water flood in next washing process.

Figure 2:
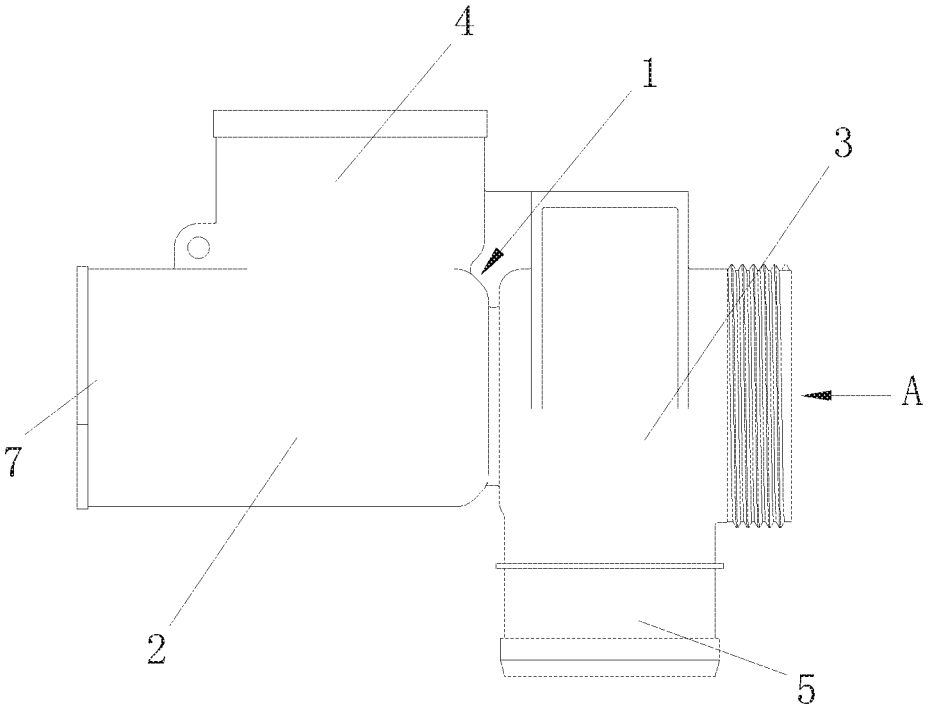
FIG. 2 is a schematic diagram of a drainage device of the present disclosure.
Figure 3:
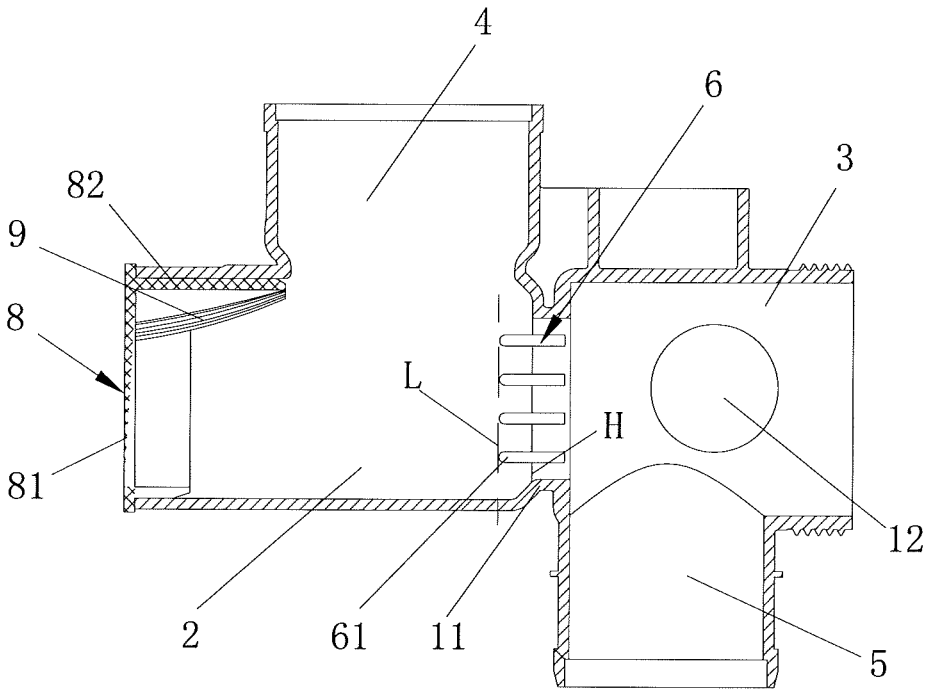
FIG. 3 is a sectional diagram of a drainage device of the present disclosure.
Figure 4:
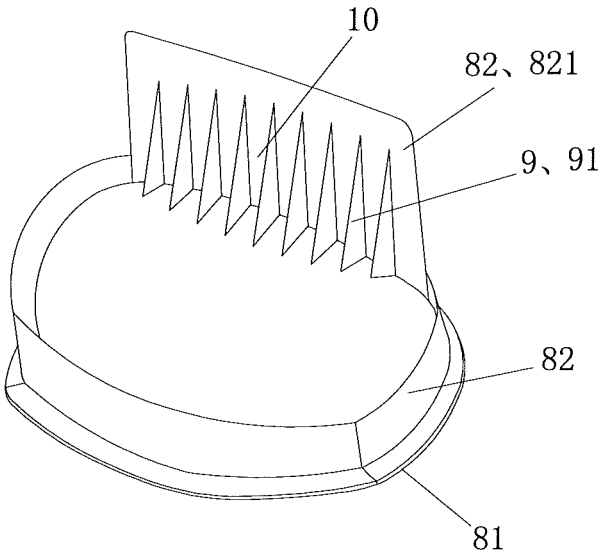
FIG. 4 is a schematic diagram of a sealing cover of the present disclosure.

As shown in from FIG. 2 to FIG. 4, the drainage device of the present disclosure comprises, a drain valve body 1. The drain valve body 1 is divided into a particle collecting and discharging chamber 2 and a drainage chamber 3 communicating with each other. The upper wall of the particle collecting and discharging chamber 2 is provided with a water inlet 4 and the water inlet 4 is communicated with a water outlet of the outer barrel drainage of the washing machine. The drainage chamber 3 is provided with a water outlet 5, a particle filtering structure 6 is provided between the particle collecting and discharging chamber 2 and the drainage chamber 3. One side of the particle collecting and discharging chamber 2 is provided with an opening 7, the opening is designed to clean up the clogging caused by accumulation of residual lint for a long time in the particle collecting and discharging chamber and to remove the broken cleaning particles. The opening 7 has a sealing cover 8 installed thereon, the sealing cover 8 comprises an outer cover 81 and an insertion portion 82; the insertion portion 82 is inserted through the opening 7, and fits the edge wall of the particle collecting and discharging chamber 2. An inner wall of the insertion portion 82 is provided with a plurality of protrusions 9 for supporting the cleaning particles. The gaps between the protrusions 9 are smaller than the minimum diameter of the cleaning particles for preventing the cleaning particles from getting stuck inside the gaps between the protrusions. The position of the upper wall of the particle collecting and discharging chamber 2 of the present disclosure is set relatively to the position of the drainage device which is installed below the washing machine, the position of the water inlet 4 is the upper direction, the opposite is the lower direction and surrounded is lateral; the inner wall of the insertion portion 82 is set to be in contact with the side wall of the particle collecting and discharging chamber 2 with respect to the insertion portion 82, and a side of the insertion portion 82 adjacent to the side being contact with the side wall of the particle collecting and discharging chamber 2 is an outer wall, the opposite side is an inner wall.

Embodiment 1

As shown in the FIG. 3, the insertion portion 82 comprises an extension 821 which is fitted to the upper surface of the particle collecting and discharging chamber and extends toward the water inlet. Protrusions 9 are provided on the lower surface of the extension 821, and the heights of the protrusions 9 are gradually lowered toward the water inlet 4 from the side of the outer cover 81, that is, the inner space of the particle collecting and discharging chamber 2 is gradually widened from the opening 7 toward the water inlet 4; the lower end surfaces of the protrusions 9 of the lower surface of the extension 821 together form a smooth inclined surface gradually increasing from the outer cover 81 toward the water inlet 4. Further, the extension 821 extends to the side wall of the water inlet 4 below, and the extension 821 and the protrusion 9 smoothly transitions to the side wall of the water inlet 4.

The smooth inclined surface makes the cleaning particles float to the water inlet 4 as the water level rises, and then enter a space between the inner and outer barrels through the drainage outlet of the outer barrel of washing machine. The cleaning particles flow in the particle collecting and discharging chamber 2 along with the drainage water during the discharging water process, and rest of the cleaning particles will be sprayed into the particle collecting and discharging chamber when the laundry is distributed during the dehydration process. During the washing and rinsing process, the cleaning particles float up as the water level of the particle collecting and discharging chamber rises, and the floating cleaning particles move in the inclined direction, that is, they move obliquely upward, so as to more easily enter the outer barrel during the water intake process.

Embodiment 2

As shown in FIG. 4, the present embodiment is a further improvement on the basis of the embodiment 1: the protrusions 9 are long ribs 91 extending from the outer cover 81 toward the water inlet 4, a strip-shaped water channel 10 is formed between adjacent long ribs 91, and the height of the long ribs 91 is lowered downward from the outer cover 81 side to the water inlet 4 direction.

Further, the long ribs 91 and the strip-shaped water channels 10 are arranged in turn at intervals. The long ribs 91 are in an upright sheet-like structure, and the lower side portion has an arc-shaped structure extending from the outer cover 81 side toward the water inlet 4. The width of strip-shaped water channel 10 is less than the minimum diameter of the cleaning particles. The arc-shaped structure of the lower edge of the long rib 91 is downward convex shape, that is, the center of the arc-shaped structure is located above the long rib. The arc-shaped structure makes the contact area between the cleaning particles and the long ribs with the long smallest when the cleaning particles floating up, which conducive to the cleaning particles floating to the water inlet.

Embodiment 3

The different between the present embodiment with the embodiment above is: the insertion portion is a cylindrical structure and the cylindrical insertion portion with a extending distance is correspondingly fitted to the side wall with a distance of the particle collecting and discharging chamber extending inwardly from the opening without blocking the water inlet; the inner wall of the insertion portion is provided with a protrusion whose end surface varies in accordance with the design for facilitating the cleaning particles to float, such as the protruding end face of the insertion portion corresponding to the side wall of the particle collecting and discharging chamber smoothly transitions from bottom to top; the protrusion end surface of the insertion portion corresponding to the lower wall of the particle collecting and discharging chamber is smoothly transitioned from the distal portion to the lower portion of the water inlet, and the above structure is not shown in the drawing.

This is due to the production process of the drainage device, and the protrusions can't be blown integrally directly on the inner wall of the particle collecting and discharging chamber, so that the protrusions are arranged on the insertion portion of the sealing cover of the opening to avoid the cleaning particles adhering on the inner wall of the particle collecting and discharging chamber.

Embodiment 4

As shown in FIG. 3, between the particle collecting and discharging chamber 2 and the drainage chamber 3 is provided with the retaining rib 11 protruding from the inner wall of the particle collecting and discharging chamber 2 so as to retain final residual water not to be discharged in the particle collecting and discharging chamber 2. The arc chamfering is provided between the water retaining rib 11 and the inner wall of particle collecting and discharging chamber 2, the side of the water retaining rib 11 corresponding to the side of the particle collecting and discharging chamber 2 is curved, and smooth transition is made with the arc chamfering.

The cleaning particles are collected in the particle collecting and discharging chamber 2 with each drainage, and the residual water is blocked by the water retaining ribs 11 so that the cleaning particles in the bottom do not contact with the bottom wall of the particle collecting and discharging chamber 2 to avoid sticking to the bottom wall for a long time which will cause blockage.

Further, the water retaining rib 11 is a raised rib formed by compressing the drain valve body 1 from outside to inside at the position between the particle collecting and discharging chamber 2 and drainage chamber 3.

Embodiment 5

Figure 5:
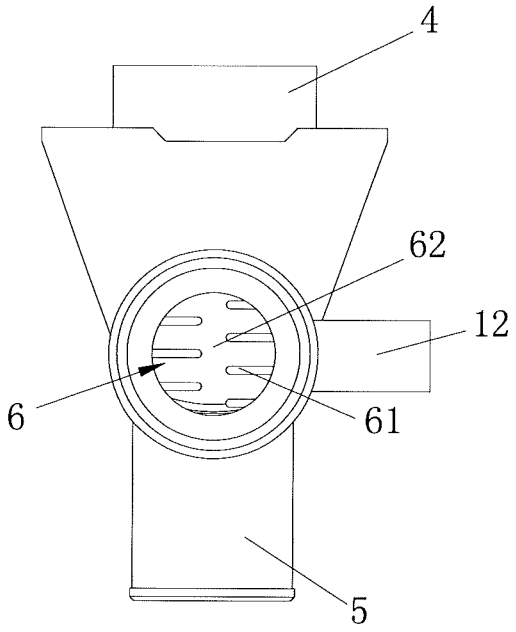
FIG. 5 is a view diagram of direction A of the drainage device from FIG. 2.

As shown in FIG. 5, the particle filtering structure 6 is a comb-shaped grid structure composed of a plurality of blocking ribs 61, and one side of the blocking ribs 61 corresponding to the particle collecting and discharging chamber 2 is protruded from the side of the water retaining ribs 11 corresponding to the particle collecting and discharging chamber. The projection of the side L of the blocking ribs 61 adjacent to the particle collecting and discharging chamber 2 on the bottom of the particle collecting and discharging chamber 2 exceeds the side H of the water retaining rib 11 (see FIG. 3), The structure prevents the lint from being blocked by the water retaining ribs, hung on the blocking ribs first, and sliding out along with water flows.

The particle filter structure 6 comprises two groups of opposing gratings, and between the two groups of gratings are narrow and long passages 62. Each group of gratings is formed as comb-shaped structure by a plurality of blocking ribs 61 extending from one side of inner wall to the passage 62 (see FIG. 5). The blocking ribs 61 are inclined to the passage from the edge toward the passages along the water discharge direction corresponding to the particle collecting and discharging chamber side, and constitute an arc-shaped inclined end surface structure form the passage position concave to the drainage chamber, the gap between two adjacent retaining ribs of each group of gratings is smoothly communicated with the passage at the end of the retaining ribs. When draining, the line-like lint hanging on the retaining ribs slides along the curved sloping end towards the end of the retaining ribs and slides out from the passage location to the drainage chamber. This structure has been disclosed in the prior application of the applicant.

Embodiment 6

As shown in FIG. 3, the water inlet 4 of the present disclosure is arranged above the side of the particle collecting and discharging chamber 2 which is close to the side of the particle filtering structure 6, and the side of the blocking rib 61 corresponding to the particle collecting and discharging chamber 2 protrudes to the projection area where the water inlet 4 is located in the particle collecting and discharging chamber 2. That is, the projection L of the side of the blocking rib 61 adjacent to the particle collecting and discharging chamber 2 on the bottom of the particle collecting and discharging chamber 2 is inside the projection of the water inlet 4 on the wall of the particle collecting and discharging chamber 2. The structure facilitates floating of the cleaning particles in front of the particle filtering structure. In contrast to the prior art, the inclination structure of the upper side of the particle collecting and discharging chamber corresponding to the particle filtering structure is reduced, and the depth of the particle collecting and discharging chamber side corresponding to the opening is relatively increased.

Further, the water outlet is arranged below the drainage chamber, the overflow outlet is provided on the side wall of the drainage chamber, and the overflow outlet is connected with the overflow port of the outer barrel through the overflow pipeline.

Embodiment 7

Figure 1:
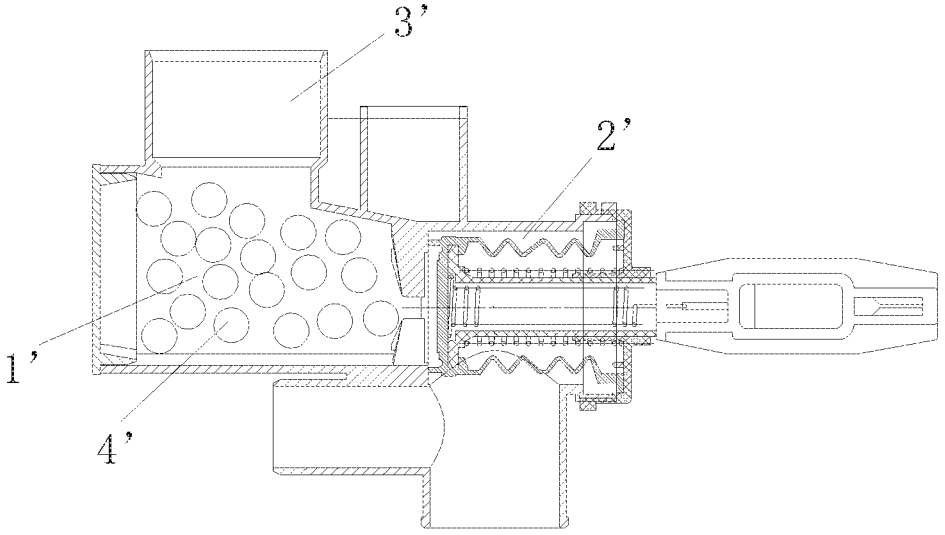
FIG. 1 PRIOR ART
FIG. 1 is a schematic diagram of a drainage device of the prior art.

As shown in FIG. 2, FIG. 3 and FIG. 5, the water outlet 5 of the present disclosure is arranged below the drainage chamber 3, the overflow outlet 12 is provided on the side wall of the drainage chamber 3, and the overflow outlet 12 is connected with the overflow port of an outer barrel through the overflow pipeline. The water inlet 4, the particle collecting and discharging chamber 2, the drainage chamber 3 and the water outlet 5 are in turn connected to form an outlet passage. A drainage valve plug is installed in the drainage chamber 3 (not shown in FIG. 3, see FIG. 1), through the drainage valve plug to control the outlet passage between the particle collecting and discharging chamber 2 and the water outlet 5 on or off.

The implementation solutions in the above embodiments can be further combined or replaced, and the embodiments merely describe preferred embodiments of the present disclosure, instead of limiting the concept and the scope of the present disclosure; without departing from the design concept of the present disclosure, various variations and improvements made to the technical solutions of the present disclosure by persons skilled in the art all belong to the protection scope of the present disclosure.

What is claimed is:

1. A drainage device of a washing machine using cleaning particles for cleaning barrel walls, comprising:

a drain valve body including a particle collecting and discharging chamber and a drainage chamber, the particle collecting and discharging chamber being in fluid communication with the drainage chamber, wherein an upper wall of the particle collecting and discharging chamber is provided with a water inlet, one side of the particle collecting and discharging chamber is provided with an opening and the drainage chamber is provided with a water outlet;

a particle filtering structure provided between the particle collecting and discharging chamber and the drainage chamber; and a sealing cover installed on the opening of the particle collecting and discharging chamber, the sealing cover including an outer cover and an insertion portion, the insertion portion being inserted through the opening, and fitting an edge the opening, wherein an inner wall of the insertion portion is provided with a plurality of protrusions and wherein a gap between adjacent protrusions of the plurality of protrusions is smaller than a minimum diameter of the cleaning particles used in the washing machine;

the insertion portion includes an extension arranged against the upper wall of the particle collecting and discharging chamber and extending toward the water inlet, the plurality of protrusions being provided on a lower surface of the extension and extending vertically downwards from a lower surface of the extension, and a vertical dimension of each protrusion of the plurality of protrusions gradually decreases in a direction toward the water inlet from the outer cover.

2. The drainage device of a washing machine according to claim 1, wherein lower end surfaces of the protrusions together form an inclined surface gradually rising from the outer cover toward the water inlet.

3. The drainage device of a washing machine according to claim 2, wherein the protrusions are convex strip-shaped ribs extending from the outer cover toward the water inlet, and a water channel is formed between adjacent strip-shaped ribs.

4. The drainage device of a washing machine according to claim 1, wherein the protrusions are convex strip-shaped ribs extending from the outer cover toward the water inlet, and a water channel is formed between adjacent strip-shaped ribs.

5. The drainage device of a washing machine according to claim 4, wherein, the strip-shaped ribs are in an erected sheet structure, and a width of the water channel is less than the minimum diameter of the cleaning particles.

6. The drainage device of a washing machine according to claim 1, wherein an inner wall of the particle collecting and discharging chamber between the particle collecting and discharging chamber and the drainage chamber is provided with a water retaining rib protruding inwardly into the particle collecting and discharging chamber so as to retain final residual water in the particle collecting and discharging chamber.

7. The drainage device of a washing machine according to claim 6, wherein the water retaining rib is a raised rib formed by compressing the drain valve body from outside to inside of the particle collecting and discharging chamber at a position between the particle collecting and discharging chamber and drainage chamber.

8. The drainage device of a washing machine according to claim 7, wherein a chamfering is provided between the water retaining rib and the inner wall of particle collecting and discharging chamber, a side of the water retaining rib facing to the particle collecting and discharging chamber is curved, and forms a smooth transition with the chamfering.

9. The drainage device of a washing machine according to claim 7, wherein the particle filtering structure is a grid structure composed of a plurality of blocking ribs which are parallel arranged, and each of the blocking ribs protrudes farther into the particle collecting and discharging chamber than the water retaining rib.

10. The drainage device of a washing machine according to claim 6, wherein a chamfering is provided between the water retaining rib and the inner wall of particle collecting and discharging chamber, a side of the water retaining rib facing to the particle collecting and discharging chamber is curved, and forms a smooth transition with the chamfering.

11. The drainage device of a washing machine according to claim 6, wherein the particle filtering structure is a grid structure composed of a plurality of blocking ribs which are arranged in parallel, and each of the blocking ribs protrudes farther into the particle collecting and discharging chamber than the water retaining rib.

12. A washing machine with the drainage device according to claim 1, wherein the washing machine comprises an outer barrel and an inner barrel, the cleaning particles for cleaning barrel walls are provided between the inner and outer barrels, and a water outlet at a bottom of the outer barrel is communicated with the drainage device below, the cleaning particles being one of the following shapes of spherical, square, oval spherical, cylindrical, tetrahedral and other irregular granular material.

* * * * *